United States Patent [19]

Takeuchi et al.

[11] Patent Number: 4,845,972

[45] Date of Patent: Jul. 11, 1989

[54] METHOD FOR WORKING THE ENDS OF STEEL PIPE BY UPSETTING AND PRESSING

[75] Inventors: Eizo Takeuchi; Hisamitsu Miyoshi; Keiichiro Mori, all of Kitakyushu City, Japan

[73] Assignee: Nippon Steel Corp., Japan

[21] Appl. No.: 131,716

[22] Filed: Dec. 11, 1987

[30] Foreign Application Priority Data

Dec. 15, 1986 [JP] Japan ..... 61-296601

[51] Int. Cl.[4] ..... B21D 41/04

[52] U.S. Cl. ..... 72/370; 72/306; 72/316

[58] Field of Search ..... 72/306, 316, 318, 356, 72/367, 370, 342

[56] References Cited

FOREIGN PATENT DOCUMENTS

| | | | |
|---|---|---|---|
| 221624 | 12/1983 | Japan | 72/367 |
| 59-76638 | 5/1984 | Japan . | |
| 59-215221 | 12/1984 | Japan . | |
| 61-46212 | 10/1986 | Japan . | |

*Primary Examiner*—Lowell A. Larson

*Attorney, Agent, or Firm*—Wenderoth, Lind & Ponack

[57] ABSTRACT

A method for working at least one end of a steel pipe by upsetting and pressing which comprises an external upset portion having an outer taper being shaped by upset forging, the portion then being pressed by an internal upset die so as to displace the outer taper to an internal upset portion having an inner taper and then internal upset forging being applied by the internal upset die, thereby forming accurately the length of the inner taper and the curvature of a starting point of the portion having the inner taper.

17 Claims, 4 Drawing Sheets

FIG. 1 (B) (PRIOR ART)

FIG. 1 (C) (PRIOR ART)

LENGTH L4' IN THE INTERNAL UPSET PORTION HAVING THE TAPER

LENGTH 4 IN THE INTERNAL UPSET PORTION

CURVATURE 5b OF A STARTING POINT IN THE INTERNAL UPSET PORTION

CURVATURE OF A STARTING POINT IN THE INTERNAL UPSET PORTION

METHOD FOR WORKING THE ENDS OF STEEL PIPE BY UPSETTING AND PRESSING

BACKGROUND OF THE INVENTION

1. Field of the Invention

The present invention relates to a method of accurate shape working of the upset end portions of steel pipe used for oil country tubular goods.

2. Description of the Prior Art

Hitherto, oil country tubular goods have been assembled by joining many lengths of steel pipe. Accordingly, the ends of the pipe have been threaded or coupled so as to improve the assembling operation efficiency.

It is necessary to finish the ends of the pipe to a prescribed shape prior to working the ends of the pipe. As a conventional method of forming the ends of the pipe, internal upset forging is applied to the ends of the pipe so as to finish said ends to a prescribed shape. (Refer to Japanese published unexamined patent application Sho No. 215221/59 and 76638/59).

According to the conventional method of internal upset forging, the wall thickness t of the ends 1 of a steel pipe heated to a working temperature is increased to a wall thickness $t_0$ by means of a die 2A and a mandrel 3A as shown in FIG. 1B, and said ends 1 are further thickened to wall thickness $t_0+a$ by changing said mandrel 3A to mandrel 3B in accordance with the wall thickness to obtain the product.

Furthermore, Japanese published examined patent application Sho No. 46212/61 discloses a method of working wherein a steel pipe subjected to external upset forging is reduced by means of a reducer so as to form a thickened wall portion inwardly and further is subjected to external upset forging to form a thickened wall portion outwardly.

However, in the case of the former, when the internal upset forging is applied, it is difficult to control the shape of the internal upset portion having a taper 4 and the length of this portion (FIG. 1B) which is not restrained by the mandrel, and furthermore underfill and buckling are apt to occur at that portion. Underfill and buckling are causes of lower operational efficiency due to the necessity for repair of the damage by grinding to an allowable limit.

In the case where the degree of said underfill and buckling is large, it becomes necessary to apply reupset forging or to scrap the material, which leads to yield problems. Furthermore, when a bending or twisting load is applied to a steel pipe such as in the drilling of an oil well, stress is easily concentrated so that cracks are apt to occur on the portion having the underfill and buckling.

In the case of the latter, on the other hand, the metal of said pipe is displaced inwardly for the thickening after shaping by external upset forging, and accordingly said method is preferable to that of the former. However, the outside diameter of the upset portion is specified as conforming to the outside diameter of the parent pipe, because the reducer is employed, furthermore, a sufficient high temperature is required for the reducing, so reheating is also required. Also, in the case where an upset portion having a more complicated shape is required, there is also problem that an additional die or working is necessary.

SUMMARY OF THE INVENTION

An object of the present invention is to provide a method of accurately shaping the ends of a steel pipe using external upsetting and pressing that excludes the bad effects ascribable to internal upset forging.

BRIEF DESCRIPTION OF THE DRAWINGS

Other and further objects of the invention will be better understood from the following detailed description with reference to the accompanying drawings, in which:

FIGS. 1A–C shows cross-sectional views il lustrating a conventional internal upset forging method;

DETAILED DESCRIPTION OF THE INVENTION

Figure 1A:
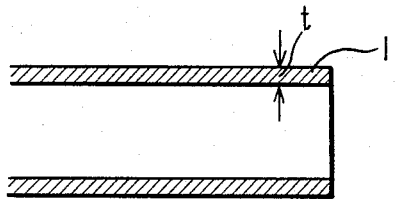
FIG. 1(A) (PRIOR ART)

A method for working the ends of a steel pipe by upsetting and pressing according to the method of the present invention comprises a process for forming an upset portion at the ends of the pipe by a method of external upset forging, a process for pressing the upset portion by means of an internal upset die used for a subsequent processing so as to reduce the upset portion inwardly and a process for further thickening the wall of an inner periphery thereof by means of said die.

Hereinafter, the present invention will be described with reference to the drawings.

As shown in FIGS. 2B and 2D, according to the method of the present invention, an upsetter provided with two sets of upset dies (2A, 2B) and mandrels (3A, 3B) are employed. The external upset forging is applied to the end 1 of a steel pipe heated to a working temperature after being rolled as shown in FIG. 2A by employing the die 2A and the mandrel 3A as shown in FIG. 2B, thereby thickening in a radially outward direction the ends of the pipe to a prescribed wall thickeness A with an outer taper 4 between the upset portion and an unupset portion of the pipe. Then, the upset portion of the pipe is deformed by the die 2B such that the outer taper 4 is worked radially inwardly to form an internal upset portion having an inner taper 5. As a result, since said external upset portion having the taper 4 is constrained by means of the die 2A and the mandrel 3A, there is no occurrence of a rough or rugged shape of said taper portion, so that a smooth shape can be obtained.

Thus, as shown in FIG. 2C, the end of the pipe is press-worked by means of the split die 2B. The press-working is performed in the diametric direction of said pipe so as to reduce inwardly the metal portion stretched in the direction of the outer periphery, and accordingly, the good shape as shown in FIG. 2B can be displaced inwardly as it is. In other words, it is possible to form the inner upset portion having the taper 5 and to provide a finished shape to the outer surface.

As shown in FIG. 2D, the end of the pipe obtained as shown in FIG. 2C is then press-worked and immediately thereafter the metal of said end is displaced inwardly by means of the mandrel 3B under a condition that the die 2B is firmly fitted thereonto so as to thicken said metal inwardly. Accordingly, it becomes possible to finish the inner shape thereof while keeping the good shape obtained shown in FIGS. 2B and 2C.

A method of working a metal pipe according to the present invention can be symmarized as follows. First, a step of upsetting an end of a metal pipe is performed such that said end becomes larger in wall thickness measured in a radial direction with an outer periphery of said pipe having a taper between said end and an un-upset portion of said pipe, said upsetting step being performed using a first die 2A having a first section, a second section and a tapered section therebetween, said first section having an inner diameter substantially equal to an outer diameter of said pipe and said second section having an inner diameter equal to a desired outer diameter of said end after said upsetting step, said upsetting step being further performed using a mandrel 3A having a first portion, a second portion and an axial end portion therebetween, said first portion having an outer diameter substantially equal to an internal diameter of said pipe, said upsetting being performed by positioning an outer periphery of said end of said pipe within said first die 2A and by moving said axial end portion of said first mandrel 3A axially into contact with and deforming a free end of said pipe. Then, a step of radially inwardly pressing said end after said upsetting step is performed such that said taper on said outer periphery of said pipe is worked in a radially inward direction to form a taper on an inner periphery of said pipe between said end and said un-upset portion of said pipe, said pressing step being performed using a second die 2B having a first section, a second section and a tapered section therebetween said first section of said second die having an inner diameter substantially equal to said inner diameter of said first section of said first die 2A and said second section of said second die having an inner diameter less than said inner diameter of said second section of said first die, said tapered section of said second die 2B having an axial length less than an axial length of said tapered section of said first die, said pressing step being performed by positioning said outer periphery of said end of said pipe within said second die 2B and deforming said end with said second die. Then, a second step of upsetting said end after said pressing step is performed such that said end becomes larger in wall thickness measured in said radial direction with an inner periphery of said end having an inner diameter which is smaller than an inner diameter of said end after said pressing step, said second upsetting step being performed using said second die 2B and a second mandrel 3B, said second mandrel having a first portion, a second portion and an axial end portion therebetween, said first portion of said second mandrel having a diameter less than said diameter of said first portion of said first mandrel, said second upsetting step being performed by positioning said outer periphery of said end of said pipe within said second die 2B and moving said axial end portion of said second mandrel 3B axially into contact with and deforming said free end of said pipe, whereby said end of said pipe after said second upsetting step has an outer diameter larger than the diameter of the un-upset portion of said pipe and an inner diameter less than the diameter of the un-upset portion of said pipe.

The other embodiment according to the method of the present invention is as follows:

As the method corresponding to the external upset forging as shown in FIG. 2B, the end of the pipe is applied to external upset forging by employing the die 2B with an engraved pattern K having an external upset shape and a mandrel 3C as shown in FIG. 2E, the end of the pipe is then moved in the opposite direction (see arrow) of the die 2B, and is applied to press-working so as to obtain an internal upset portion as shown in FIG. 2F. Thereafter the internal upset portion is thickened by a mandrel, such as the mandrel 3B used in the earlier described method as shown in FIG. 2D, so that external and internal surfaces of good shape may also be obtained. The die 2B is a split type.

As a result, the smooth shape obtained by the external upset forging can still be maintained even after the pressing. However, in the case also where the finished shape has been obtained by the internal upset forging, said smooth shape can be maintained as it is because of the small thickening ratio of the internal upset portion having the taper.

A second method of working a metal pipe according to the present invention can be summarized as follows. First a step of upsetting an end of a metal pipe is performed such that said end becomes larger in wall thickness measured in a radial direction with an outer periphery of said pipe having a taper 4 between said end and an un-upset portion of said pipe, said upsetting step being performed using a die 2B having a first section, a second section and a tapered section therebetween, said first section having an inner diameter substantially equal to an outer diameter of said pipe and said second section having an inner diameter equal to a desired outer diameter of said end after said upsetting step, said upsetting step being further performed using a first mandrel 3C having a first portion, a second portion and an axial end portion therebetween, said first portion having an outer diameter substantially equal to an internal diameter of said pipe, said upsetting being performed by positioning an outer periphery of said end of said pipe within said die and by moving said axial end portion of said first mandrel axially into contact with and deforming a free end of said pipe. Then, a step of raidally inwardly pressing said end after said upsetting step is performed such that said taper 4 on said outer periphery of said pipe is worked in a radially inward direction to form a taper 5 on an inner periphery of said pipe between said end and said un-upset portion of said pipe, said pressing step being performed using said die 2B, said die 2B including an engraved pattern in said first section thereof, said engraved pattern comprising an annular recess K in said first section, said recess having an axially extending section with a diameter greater than said diameter of said first section, said die having a second tapered section between said axially extending section of said recess and part of said first section, said recess being between said part of said first section and said second section, said pressing step being performed by positioning an outer periphery of said end of said pipe within said recess and deforming said end with said die. Then, a second step of upsetting said end after said pressing step is performed such that said end becomes larger in wall thickness measured in said radial direction with an inner periphery of said end having an inner diameter which is smaller than an inner diameter of said end after said pressing step, said second upsetting step being performed using said die 2B and a second mandrel 3B, said second mandrel 3B having a first portion, a second portion and an axial end portion therebetween, said first portion of said second mandrel having a diameter less than said diameter of said first portion of said first mandrel 3C, said second upsetting step being performed by positioning said outer periphery of said end of said pipe within said recess K and moving said axial end portion of said second mandrel 3B axially into contact with and deforming said free end of said pipe, whereby said end of said pipe after said second upsetting step has an outer diameter larger than the diameter of the un-upset portion of said pipe and an inner diameter less than the diameter of the un-upset portion of said pipe.

Owing to the improvement of the shape of said upset portion having the taper of the end of the pipe, repair by grinding after upset forging considerably can be decreased, so that lowering of the yield can be prevented. Moreover, since the shape of said internal upset portion having the taper 5 is formed by pressing the external upset portion, the length of the internal upset portion having the taper and the curvature **5*b*** of the starting point of said taper portion can be controlled accurately and easily.

As described above, according to the method of the present invention, it is possible to work accurately the upset portion of the ends of the pipe which requires accuracy of shape and length of the internal upset portion having the taper as in the case of oil country tubular goods, etc.

EXAMPLE

Hereinafter, the effect obtainable according to the present invention will be described by way of an embodiment thereof.

Figure 2:
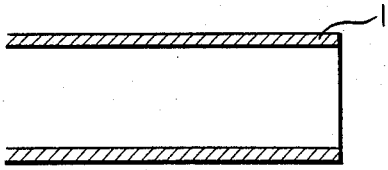
FIGS. 2A–F show cross-sectional views illustrating a state wherein the ends of a pipe are applied to external upset forging after being rolled and are then pressed, according to the method of the present invention.
Figure 2:
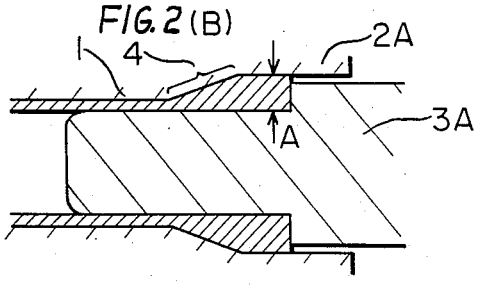
Figure 2:
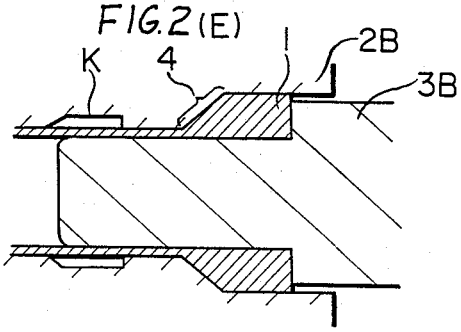
Figure 2:
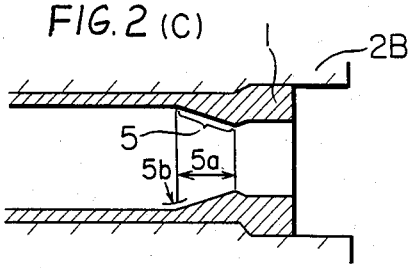
Figure 2:
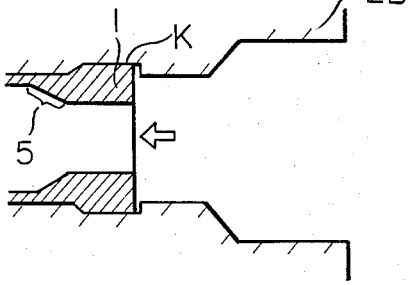
Figure 2:
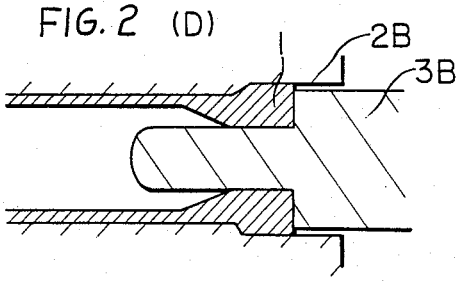

FIG. 2 shows cross-sectional views of the ends of a pipe applied to external upset forging according to the method of the present invention, and thereafter press-worked, using an upset die, immediately thereafter, internal upset forging thereto under the state as it is.

Figure 3:
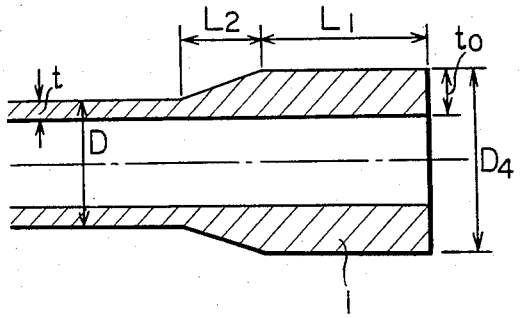
FIG. 3 is a view for explaining dimensions of each portion of the steel pipe applied to external upset forging.
Figure 4:
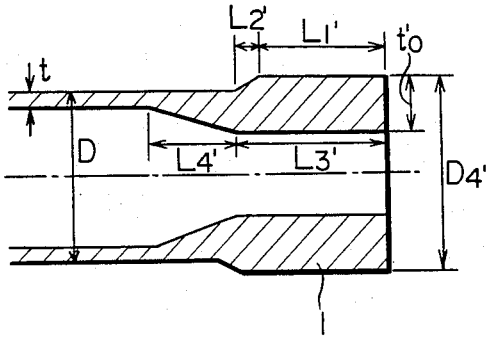
FIG. 4 is a view for explaining the dimension of each portion of the pipe which has been pressed.

In the present embodiment, the ends 1 of a steel pipe having an outer diameter of 127.0 mm and wall thickness of 9.19 mm were heated to a temperature of from 1000° C. to 1250° C. such as by induction heating or gas-furnace heating. The ends of the pipe thus heated were applied to external upset forging by an upsetter employing a conventional die and a mandrel so as to obtain the shape of the ends having the wall thickness A as shown in FIG. 2B. At that time, a portion 5 forming the internal upset portion having the taper was shaped as an external upset portion 4 having the taper. Dimensions of each portion of the ends of the pipe thus shaped as shown in FIG. 3 were as follows:

(1) Outer diameter D of the pipe: 127.0 mm
(2) Initial wall thickness t of the pipe: 9.19 mm
(3) Wall thickness $t_O$ of the thickened wall portion A: 15.3 mm
(4) Length $L_1$ of the parallel portion of the external upset portion: 160 mm
(5) Length $L_2$ of the taper portion of the external upset portion: 100 mm
(6) Outer diameter $D_4$ of the external upset portion: 139.2 mm Next, the ends of the pipe applied to external upset forging by means of an upsetter as shown in FIG. 2C were pressed by employing the die 2B so as to obtain the finished shape of the external surface thereof and also to obtain stretching of the metal portion inwardly. The die 2B was a split type. Immediately thereafter, the internal shape thereof was made to the finished shape shown in FIG. 2D by employing the mandrel 3B under a state of fitting firmly said die 2B. Dimensions of each portion of the product (FIG. 4) were as follows:

(1) Outer diameter D of steel pipe: 127.0 mm
(2) Initial wall thickness t of the pipe: 9.19 mm
(3) Wall thickness $t'_0$ of the thickened wall portion A: 20.8 mm
(4) Length $L_1'$ of the parallel portion of the external upset portion: 94 mm
(5) Length $L_2'$ of the external upset portion having the taper: 30 mm
(6) Length $L_3'$ of the parallel portion of the internal upset: 130 mm
(7) Length $L_4'$ of the internal upset portion having the taper: 100 mm
(8) Outer diameter $D_4'$ of the external upset portion: 132.6 mm Furthermore, the length $L_4'$ of the internal upset portion having the taper was $\sigma=4$ mm; $x=100$ mm relative to an objective value of 100 mm as shown in FIG. 5A, having almost no deviation.

Figure 1A:
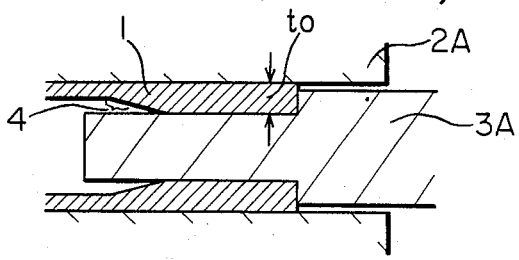
FIG. 1(A) (PRIOR ART)
Figure 1A:
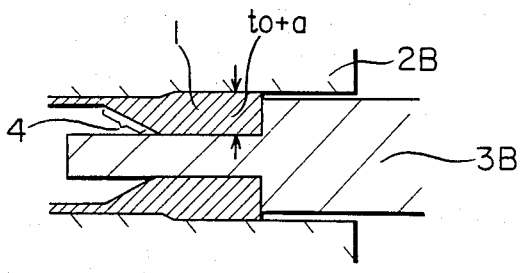
FIG. 1(A) (PRIOR ART)
Figure 5:
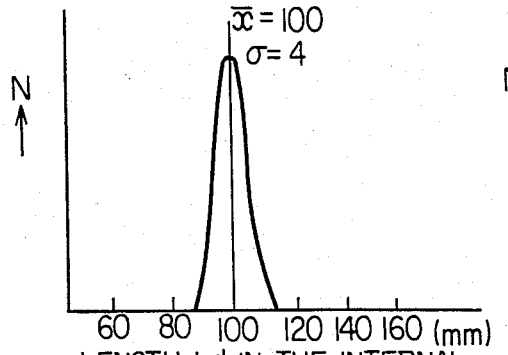
FIGS. 5A and 5B are, respectively, a comparative view illustrating variation from the required values of the length $L_4'$ of the internal upset portion having the taper according to the method of the present invention, and a conventional method; and, FIGS. 6A and 6B are respectively, a comparative view concerning the curvature of a starting point of the internal upset portion having the taper according to the method of the present invention, and a conventional method.
Figure 5:
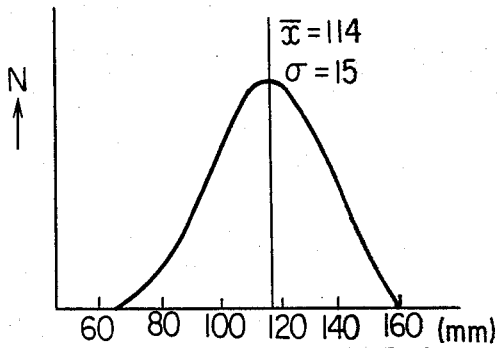
Figure 6:
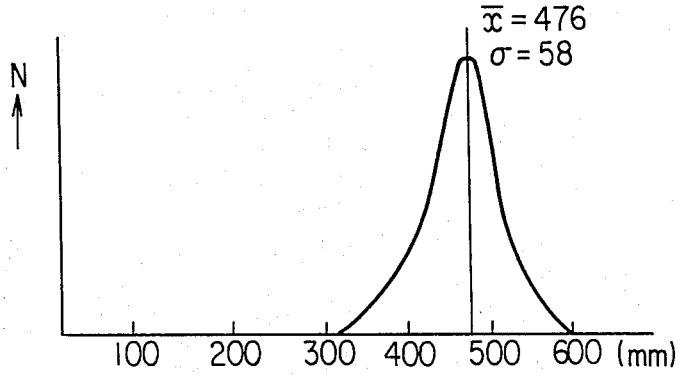
Figure 6:
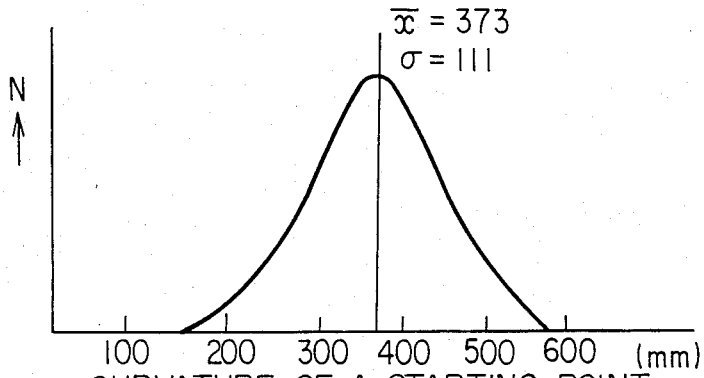

FIG. 5B shows the case where a conventional working method as shown in FIG. 1 was employed. Regarding the curvature of a starting point **5*b* of the internal upset portion shown in FIG. 2C, the good results of $\sigma=58$ mm; $x=476$ mm relative to a desired value of 450 mm were obtained (FIG. 6A). According to the conventional method, as shown in FIG. 6B, the curvature of a starting point (5*b* in FIG. 2C**) of the internal upset portion having the taper was $x=373$ mm; $\sigma=111$ mm, which obviously will not provide the shape exactly conforming to the desired value.

According to the method of the present invention, furthermore, there is no occurrence of underfill and buckling on the circumference of the internal upset portion having the taper, the said portion being rectilinear at any cross sectional area, so that an ideal shape is obtained. Reupsetting may be applied as required. Furthermore, since the outer diameter is thickened in wall owing to the reduction thereof after being pressed, working quantity of the external upset forging is determined in anticipating said thickening of the wall.

Furthermore, in the pressing, a mandrel or die at the sides of the inner surface of the ends of the pipe and the end surface thereof may be devised so as to constrain said portions. Furthermore, the present embodiment was described with reference to both external and internal upset forging, but the embodiment can also be applicable to either internal or external upset forging only.

As described above, according to the method of the present invention, the internal upset forging is applied by press-working after shaping the wall thickness on the ends of the pipe by external upset forging, and further shaping an external upset portion having the taper; and accordingly it is possible to prevent the occurrence of bad shaping such as underfilling and buckling on the portions not supported on the mandrel at the time of the internal upset forging.

Furthermore, according to said method, since the thickened wall portion is formed on the ends of the pipe by the external upset forging and a taper portion is also shaped, accurate calculation of the inside diameter can be expected at the time of the internal upset forging, and it becomes possible to control freely the length and shape of the internal upset portion having the taper. As described above, according to the present invention, it is possible to manufacture a product of good quality by efficient working of the ends of the pipe.

What is claimed is:

1. A method of working the ends of a steel pipe by external upset and internal upset forging, comprising:

external upsetting for shaping a wall thickness A thickened at an external periphery of the ends of a steel pipe and further shaping an outer taper portion 4 gradually reduced from said wall thickness by employing a first mandrel 3A while holding said pipe by a first die 2A;

press-working for shaping an inner taper portion 5 by displacing said wall thickness A and the outer taper portion 4 to an inner side of side pipe by moving a second die 2B in an axial direction;

internal upsetting for thickening the wall thickness in a radially inward direction at an end of said pipe by inserting a second mandrel 3B into the steel pipe held by said second die 2B;

external upsetting for shaping the wall thickness A so as to be thickened radially outwardly at said end of said pipe and the taper portion 4 gradually reduced therefrom by inserting a mandrel 3C thereinto while holding said pipe by employing said second die 2B with an engraved pattern K at a desired position; and press-working for shaping a taper portion 5 by displacing said wall thickness A and the taper portion 4 to an inner side of the pipe by moving the mandrel 2B in said axial direction such that said wall thickness A of said steel pipe is pressed into said engraved pattern K.

2. A method of working a metal pipe, comprising:

a step of upsetting an end of a metal pipe such that said end becomes larger in wall thickness measured in a radial direction with an outer periphery of said pipe having a taper between said end and an un-upset portion of said pipe, said upsetting step being performed using a die having a first section, a second section and a tapered section therebetween, said first section having an inner diameter substantially equal to an outer diameter of said pipe and said second section having an inner diameter equal to a desired outer diameter of said end after said upsetting step, said upsetting step being further performed using a first mandrel having a first portion, a second portion and an axial end portion therebetween, said first portion having an outer diameter substantially equal to an internal diameter of said pipe, said upsetting being performed by positioning an outer periphery of said end of said pipe within said die and by moving said axial end portion of said first mandrel axially into contact with and deforming a free end of said pipe;

a step of radially inwardly pressing said end after said upsetting step is performed such that said taper on said outer periphery of said pipe is worked in a radially inward direction to form a taper on an inner periphery of said pipe between said end and said un-upset portion of said pipe, said pressing step being performed using said die, said die including an engraved pattern in said first section thereof, said engraved pattern comprising an annular recess in said first section, said recess having an axially extending section with a diameter greater than said diameter of said first section, said die having a second tapered section between said axially extending section of said recess and part of said first section, said recess being between said part of said first section and said second section, said pressing step being performed by positioning an outer periphery of said end of said pipe within said recess and deforming said end with said die, and a second step of upsetting said end after said pressing step such that said end becomes larger in wall thickness measured in said radial direction with an inner periphery of said end having an inner diameter which is smaller than an inner diameter of said end after said pressing step, said second upsetting step being performed using said die and a second mandrel, said second mandrel having a first portion, a second portion and an axial end portion therebetween, said first portion of said second mandrel having a diameter less than said diameter of said first portion of said first mandrel, said second upsetting step being performed by positioning said outer periphery of said end of said pipe within said recess and moving said axial end portion of said second mandrel axially into contact with and deforming said free end of said pipe, whereby said end of said pipe after said second upsetting step has an outer diameter larger than the diameter of the un-upset portion of said pipe and an inner diameter less than the diameter of the un-upset portion of said pipe.

3. The method of claim 2, wherein after said second upsetting step an inner periphery of said end of said pipe is spaced further radially from an inner periphery of said un-upset portion of said pipe than an outer periphery of said end of said pipe is spaced radially from an outer periphery of said un-upset portion of said pipe.

4. The method of claim 2, wherein said second portion of said first mandrel has an outer diameter no greater than said inner diameter of said second section of said first die.

5. The method of claim 2, wherein said die is a split die.

6. The method of claim 2, wherein said axial end portion of said first mandrel extends perpendicularly to an outer periphery of said first portion of said first mandrel.

7. The method of claim 2, wherein said axial end portion of said second mandrel extends perpendicularly to an outer periphery of said first portion of said second mandrel.

8. The method of claim 2, wherein said metal pipe is a steel pipe.

9. The method of claim 8, wherein said steel pipe is heated to a temperature of about 1000 degrees centigrade to 1250 degrees centigrade prior to said first upsetting step.

10. A method of working a metal pipe, comprising:

a step of upsetting an end of a metal pipe such that said end becomes larger in wall thickness measured in a radial direction with an outer periphery of said pipe having a taper between said end and an un-upset portion of said pipe, said upsetting step being performed using a first die having a first section, a second section and a tapered section therebetween, said first section having an inner diameter substantially equal to an outer diameter of said pipe and said second section having an inner diameter equal to a desired outer diameter of said end after said upsetting step, said upsetting step being further performed using a first mandrel having a first portion, a second portion and an axial end portion therebetween, sid first portion having an outer diameter substantially equal to an internal diameter of said pipe, said upsetting being performed by positioning an outer periphery of said end of said pipe within said first die and by moving said axial end portion of said first mandrel axially into contact with and deforming a free end of said pipe;

a step of radially inwardly pressing said end after said upsetting step such that said taper on said outer periphery of said pipe is worked in a radially inward direction to form a taper on an inner periphery of said pipe between said end and said un-upset portion of said pipe, said pressing step being performed using a second die having a first section, a second section and a tapered section therebetween, said first section of said second die having an inner diameter substantially equal to said inner diameter of said first section of said first die and said second section of said second die having an inner diameter less than said inner diameter of said second section of said first die, said tapered section of said second die having an axial length less than an axial length of said tapered section of said first die, said pressing step being performed by positioning said outer periphery of said end of said pipe within said second die and deforming said end with said second die; and a second step of upsetting said end after said pressing step such that said end becomes larger in wall thickness measured in said radial direction with an inner periphery of said end having an inner diameter which is smaller than an inner diameter of said end after said pressing step, said second upsetting step being performed using said second die and a second mandrel, said second mandrel having a first portion, a second portion and an axial end portion therebetween, said first portion of said second mandrel having a diameter less than said diameter of said first portion of said first mandrel, said second upsetting step being performed by positioning said outer periphery of said end of said pipe within said second die and moving said axial end portion of said second mandrel axially into contact with and deforming said free end of said pipe, whereby said end of said pipe after said second upsetting step has an outer diameter larger than the outer diameter of the un-upset portion of said pipe and an inner diameter less than the inner diameter of the un-upset portion of said pipe.

11. The method of claim 10, wherein after said second upsetting step an inner periphery of said end of said pipe is spaced further radially from an inner periphery of said un-upset portion of said pipe than an outer periphery of said end of said pipe is spaced radially from an outer periphery of said un-upset portion of said pipe.

12. The method of claim 10, wherein said second portion of said first mandrel has an outer diameter no greater than said inner diameter of said second section of said first die.

13. The method of claim 10, wherein said first and second dies are split dies.

14. The method of claim 10, wherein said axial end portion of said first mandrel extends perpendicularly to an outer periphery of said first portion of said first mandrel.

15. The method of claim 10, wherein said axial end portion of said second mandrel extends perpendicularly to an outer periphery of said first portion of said second mandrel.

16. The method of claim 10, wherein said metal pipe is a steel pipe.

17. The method of claim 16, wherein said steel pipe is heated to temperature of about 1000 degrees centigrade to 1250 degrees centigrade prior to said first upsetting step.

* * * * *